United States Patent [19]

Piorunneck et al.

[11] Patent Number: 5,035,631

[45] Date of Patent: Jul. 30, 1991

[54] GROUND SHIELDED BI-LEVEL CARD EDGE CONNECTOR

[75] Inventors: Heinz Piorunneck, Trumbull; Rocco J. Noschese, Wilton, both of Conn.; Fernando J. Ramirez, Fountain Valley, Calif.

[73] Assignee: Burndy Corporation, Norwalk, Conn.

[21] Appl. No.: 532,300

[22] Filed: Jun. 1, 1990

[51] Int. Cl.[5] ..... H01R 4/66

[52] U.S. Cl. ..... 439/108; 439/630

[58] Field of Search ..... 439/101, 108, 95, 609, 439/636, 637, 607, 629–635, 92

[56] References Cited

U.S. PATENT DOCUMENTS

| | | | |
|---|---|---|---|
| 3,399,372 | 8/1968 | Uberbacher | 439/101 |
| 3,587,029 | 6/1971 | Knowles | 439/108 |
| 3,744,005 | 7/1973 | Sitzler | 439/108 |
| 4,298,237 | 11/1981 | Griffith et al. | 439/630 |
| 4,655,518 | 4/1987 | Johnson et al. | 339/17 LC |
| 4,659,155 | 4/1987 | Wallkup et al. | 439/108 |
| 4,705,338 | 11/1987 | Sitzler | 439/630 |
| 4,780,087 | 10/1988 | Berg et al. | 439/92 |
| 4,806,103 | 2/1989 | Kniese et al. | 439/630 |
| 4,836,791 | 6/1989 | Grabbe et al. | 439/79 |
| 4,898,546 | 2/1990 | Elco et al. | 439/608 |
| 4,934,961 | 6/1990 | Piorunneck et al. | 439/637 |

FOREIGN PATENT DOCUMENTS 1048062 11/1966 United Kingdom .

*Primary Examiner*—Larry I. Schwartz
*Assistant Examiner*—Hien D. Vu
*Attorney, Agent, or Firm*—Perman & Green

[57] ABSTRACT

A card edge connector of the type used to connect a daughter printed circuit board with a mother printed circuit board. The connector has a housing, a plurality of signal contacts, and an electromagnetic grounding shield to prevent electromagnetic impulses from generating or degrading signals in the signal contacts.

28 Claims, 4 Drawing Sheets

GROUND SHIELDED BI-LEVEL CARD EDGE CONNECTOR

BACKGROUND OF THE INVENTION

1. Field of the Invention

This invention relates to electrical connectors and, more particularly, to card edge connectors having a grounding shield and a method of manufacturing the same.

2. Prior Art

In electrical arts it is a common practice to use a connector to mechanically and electrically couple a mother printed circuit board with a daughter printed circuit board as of the vertical edge card variety. In such a practice, there has been an evolution towards placing electrical contacts closer and closer together while maintaining a high, constant stress between the electrical contacts and the areas to be contacted. In placing the contacts closer together, as to 20 contacts per linear inch, the width of each contact must decrease. One such connector is found in U.S. Pat. No. 4,846,734, entitled "Vertical Edge Card Connectors" by Thomas G. Lytle which is assigned to the same assigned as herein and is incorporated by reference in its entirety herein.

There has also been developed a special type of connector which is known in the art as a bi-level connector; i.e.; a connector having two types of contacts that make contact with a daughter printed circuit board in two locations or at two levels. The two types of contacts are generally intermixed or alternatingly arranged in two opposing rows. The first type of contacts are arranged at a predetermined pitch, such as 100 mils, between the first type of contacts. The second type of contacts are also arranged at a predetermined pitch, such as 100 mils, between the second type of contacts such that there is a 50 mils pitch between the adjacent first and second contacts. One such connector is described in copending patent application Ser. No. 7/287,765, filed Dec. 21, 1988, now U.S. Pat. No. 4,934,961, entitled "Bi-Level Card Edge Connector and Method of Making The Same" by Piorunneck et al. which is assigned to the same assignee as herein and which is incorporated by reference in its entirety hereby. U.S. Pat. No. 3,399,372 to Uberbacher discloses a card edge connector having a plurality of thin sheet metal type ground contacts located between signal contacts. British Patent 1,048,062 discloses a connector having two flat side plates made of metal used to connect connector units into an assembly. U.S. Pat. No. 4,655,518 to Johnson et al. discloses a backplane connector having a daughter board connector element with contacts on the outside for grounding purposes and a backplane connector element with sidewall contacts.

One particular problem that has arisen with prior art card edge connectors is electrically induced magnetism or electromagnetism generated by electricity traveling through the contacts which can cause the undesired generating of electricity in adjacent contacts in the connector, also known as cross-talk. This undesired generation of electricity can cause false signals or degradation of true signals to be transmitted to the mother and daughter printed circuit boards. This obviously interferes with the proper utilization and reliability of such an assembly.

A further problem that has arisen with prior art card edge connectors is that daughter printed circuit boards have circuitry that needs to be grounded, preferably to the mother board at the same card edge connector as signals are transmitted through, such that only one connector is needed. However, by transmitting electricity through ground contacts in the connectors of the prior art, a relatively long travel distance or path was needed. These relatively long grounding paths in the prior art reduced switching time.

It is therefore an objective of the present invention to provide a new and improved connector and method of manufacturing the same that can overcome the above problems in the prior art as well as provide additional features and advantages.

SUMMARY OF THE INVENTION

The foregoing problems are overcome and other advantages are provided by a card edge connector having a grounding shield and a method of making the same.

In accordance with one embodiment of the present invention an electrical connector for mechanically and electrically connecting a mother printed circuit board and a removable daughter printed circuit board of the edge card type is provided. The connector comprises a housing, a plurality of a first type of contacts, a plurality of a second type of contacts, and a ground shield. The housing is comprised of an electrically insulating material and has a top surface with a slot for receiving a portion of a daughter printed board and at least two rows of contact chambers on opposite sides of the slot. The first type of contacts are positioned in at least some of the contact chambers. The second type of contacts are also positioned in at least some of the contact chambers. The ground shield is positioned along an exterior surface of the housing and comprises an electrically conductive plate with solder tails extending from a bottom portion of the plate for coupling with a mother printed circuit board, finger portions extending into the housing, and a top portion extending above the housing top surface. Each finger portion is located in an area between two of the first type of contacts in one of the rows. The top portion is provided for connection to grounding portions on a daughter printed circuit board such that electricity from the daughter printed circuit board ground portions can be transmitted to a mother printed circuit board along a relatively short path and, electromagnetic forces generated by electricity flowing through the first type of contacts can be, at least partially, intercepted by the ground shield finger portion and transmitted to a mother printed circuit board.

In accordance with another embodiment of the present invention an electrical connector for mechanically and electrically connecting a mother printed circuit board and a removable daughter printed circuit board of the edge card type is provided. The connector comprises a housing means, means for contacting conductive traces on a daughter board, and means for grounding electromagnetic forces. The housing means is comprised of an electrically insulating material and has at least two rows of contact housing chambers and a central aperture between the rows for receiving a portion of a daughter printed circuit board. The means for contacting conductive traces on a daughter board comprises a plurality of a first type of electrically conductive contacts. Each of the first type of contacts comprises a first portion formed as a solder tail positionable to extend from the housing for coupling with a mother printed circuit board and a contacting portion for contacting a daughter printed circuit board. The contacting portion is partially displaceable from a home position by insertion of a daughter printed circuit board into the central aperture. The means for grounding electromagnetic forces includes at least one grounding member comprised of an electrically conductive material having a mother board contacting section, a projecting finger section and a middle section therebetween. The projecting finger section comprises at least two projecting fingers. Each of the fingers extends into the housing in an area between two of the first type of contacts. The middle section is located on an exterior side of the housing means between the mother board contacting section and the projecting finger section and connects the fingers.

In accordance with another embodiment of the present invention an electrical connector for mechanically and electrically connecting a mother printed circuit board and a removable daughter printed circuit board of the edge card type is provided. The connector comprises an elongate housing, a plurality of a first type of contacts, and a grounding shield. The elongate housing is comprised of a dielectric material and has a top surface with a slot for receiving a portion of a daughter printed circuit board and at least two rows of contact chambers on opposite sides of the slot. The plurality of first contacts are located in at least some of the contact chambers. The grounding shield comprises two exterior grounding plates located on opposite elongate sides of the housing. Each of the grounding plates has a mother board contacting section, a daughter board contacting section and a middle section therebetween. The daughter board contacting section extends above the housing top surface for contacting grounding portions on a daughter board such that electricity from the daughter board ground portion can be transmitted to a mother board along a relatively short path and, electromagnetic forces generated by electricity flowing through the contacts can be at least partially intercepted by the grounding shield and transmitted to a mother board to reduce cross talk between contacts in the rows.

In accordance with another embodiment of the present invention an electronic component assembly is provided comprising a mother printed circuit board, an electrical connector, and a daughter printed circuit board. The electrical connector is mechanically and electrically connected to the mother printed circuit board with a slot in a top surface of the connector. The connector has a plurality of spring contacts projecting into the slot that also have opposite ends connected to the mother printed circuit board. The connector further comprises a grounding shield having a bottom portion connected to the mother printed circuit board and a top portion extending above the housing top surface. The daughter printed circuit board is connected to the connector with conductive traces on the daughter board being located in the connector slot contacted by the contacts, and further comprises surface mounted grounding contacts located above the slot which contact the grounding shield top portion.

In accordance with one method of the invention, a method of manufacturing a card edge connector is provided comprising the steps of providing an elongate housing of dielectric material having an area for receiving a portion of a daughter printed circuit board and a plurality of spring contact receiving areas; inserting and mounting a plurality of spring contacts in the spring contact receiving areas, the contacts being capable of electrically connecting a received daughter printed circuit board with a mother printed circuit board for transmitting signals therebetween; and mounting a grounding shield to the housing, the shield being comprised of ferromagnetic material and having a general elongate shape with a daughter board contacting portion extending above the housing and a mother board contacting portion extending below the housing, the grounding shield being orientated generally parallel to the spring contacts such that the shield can at least partially intercept electromagnetic impulses generated by electricity traveling through the contacts and thereby reduce cross-talk between contacts and reduce the grounding travel distance between the daughter and mother boards.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
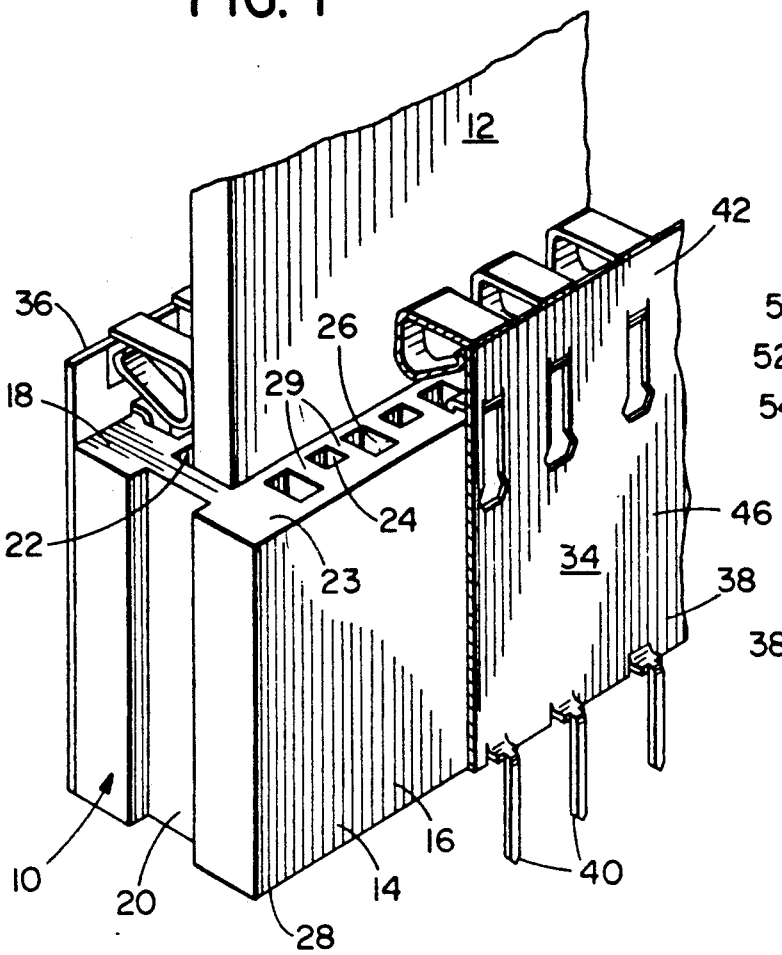
FIG. 1 is a partial perspective view of a card edge connector incorporating features of the present invention with a daughter printed circuit board connected thereto.

Referring to FIG. 1, there is shown a partial perspective view of a card edge connector 10 incorporating features of the present invention. Although the present invention is being described with reference to the embodiments shown in the drawings, it should be understood that the present invention can be embodied in many different alternate embodiments with any suitable size, shape, configuration or type of elements.

Figure 3:
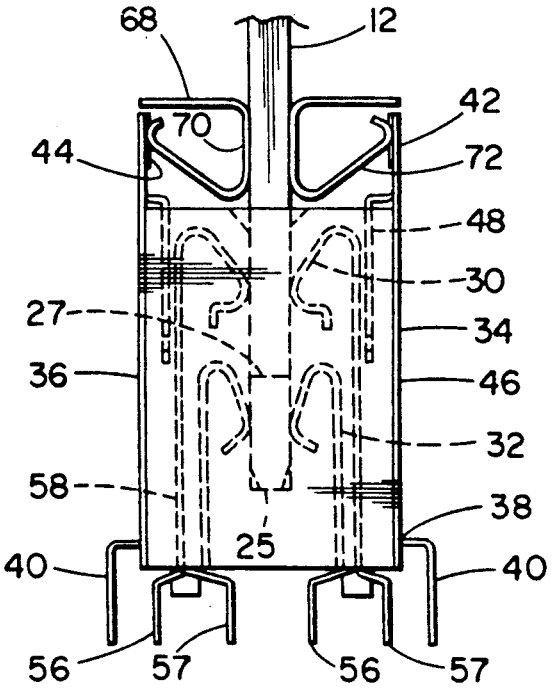
FIG. 3 is an end view of the connector shown in FIG. 1.

The connector 10 shown in FIG. 1 generally comprises a housing 14, a plurality of an upper or first type of electrical contacts 30 (see FIG. 3), a plurality of a lower or second type of electrical contacts 32 (see FIG. 3), and two grounding shields 34 and 36. The housing 14, in the embodiment shown, is a general rectangular or box shaped member with an extended length largely determined by the number of contacts to be supported therein. The housing 14 is generally comprised of an electrically insulating dielectric material and has a general elongate length with a top 23, a bottom 28, two sides 16 and 18, and two ends 20 (only one of the ends is shown in FIG. 1). The majority of the bulk of the housing 14 is essentially comprised of the parallel side walls 16 and 18 extending the entire length of the housing 14. The end walls 20 are generally formed integrally at the ends of the side walls 16 and 18 with sufficient thickness to add rigidity to the housing 14. Referring also to FIG. 3, a plan end view of the connector 10 shown in FIG. 1 is shown with an inserted daughter printed circuit board 12. The housing 14 generally comprises a card edge receiving slot 22 extending into the housing from the top 23. The slot 22 extends down into the housing 14 along substantially its entire height and is generally intended to receive a portion of the daughter printed circuit board 12. In the embodiment shown, the housing 14 also has a card stop portion 25 located at the bottom of the slot 22 extending between the housing end walls 20. The card stop portion 25 is generally intended to limit the furthest most depth of insertion of a daughter board. The housing 14 may also comprise intermediate walls (not shown) between the two sides walls 16 and 18 that add rigidity to the housing 14 and also act as a polarizing or registration means to form multiple slots 22 in the housing 14 as is known in the art. In the embodiment shown, the housing 14 also comprises suitable bi-level keying projections 27 for positioning different types of daughter boards at different levels in the housing 14 when inserted, such as disclosed in copending patent application Ser. No. 07/287,765, now U.S. Pat. No. 4,934,961. Located in the interior of the housing 14 and communicating with the slot 22 are two rows of contact chambers on opposite sides of the slot 22. Although contact chambers are described with reference to the embodiments shown, it should be understood that any suitable means may be provided to keep adjacent contacts separated from each other. Located between and at least partially defining adjacent contact chambers are separating walls 29 of the housing 14 which at least partially form the contact chambers and aid in keeping contacts in one contact chamber from contacting contacts in an adjacent contact chamber. In the embodiment shown, each row of contact chambers comprises alternating first type of contact chambers 24 and second type of contact chambers 26. The first type of contact chambers 24 are generally intended to receive the upper type of contacts 30. The second type of contact chambers 26 are generally intended to receive the lower type of contacts 32. In the embodiment shown, the contact chambers 24 and 26 are open at the housing top 23 with the second type of contact chambers 26 having a relatively wider opening at the housing top. Although two types of contact chambers have been described above, it should be understood that the present invention need not have two types of contact chambers. In addition, the present invention need not be provided with contact chambers that have openings at the housing top 23.

As mentioned above, the connector 10 has two types of signal contacts; upper contacts 30 and lower contacts 32. The contacts 30 and 32 are generally made of an electrically conductive material and have a daughter board contacting portion located proximate the slot 22 and mother board contacting portions 56 and 57 which, in the embodiment shown, extend from the housing bottom 28. The upper contacts 30 generally have their daughter board contacting portions located in a position nearer to the top of the slot 22 than the lower contact daughter board contacting portions. In the embodiment shown, both the upper and lower contacts 30 and 32 are spring contacts with intermediate portions 58 fixedly mounted in the housing 14 with the aid of suitable barbs or the like (not shown). The daughter board contacting portions project from the contact chambers 24 and 26 into the card receiving slot 22 and are intended to be at least partially pushed away from the slot 22 by an inserted daughter board and make contact with conductive traces on the daughter board. In the embodiment shown, the mother board contacting portions 56 and 57 are provided as solder tails. However, any suitable means of electrically connecting the contacts 30 and 32 to a mother board may be provided including surface mounting. Although the connector 10 has been described as having two types of signal contacts, it should be understood that only one type of contact need be provided or alternatively, more than two types of signal contacts can be provided. In addition, the connector 10 need not be a bi-level connector, but may be a single level or several level connector.

Figure 2A:
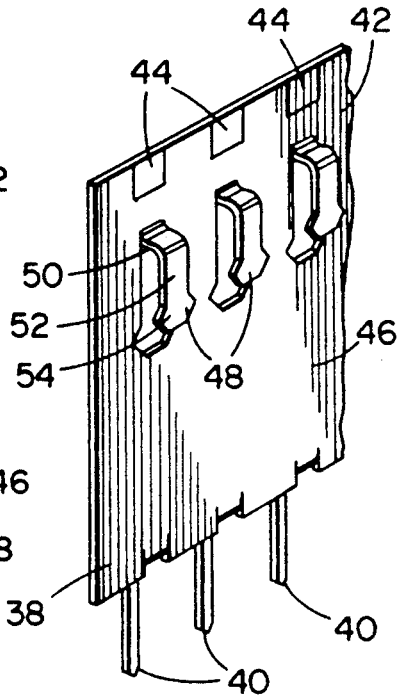
FIG. 2*a* is a partial perspective view of a grounding shield used in the connector shown in FIG. 1.

In the embodiment shown, the connector 10 has two grounding shields 34 and 36 which are mounted to the exterior of the sides 16 and 18. FIG. 1 shows a cut away view of the first grounding shield 34. Referring also to FIG. 2A, a partial perspective view of the second shield 36 is shown. The shields 34 and 36 are comprised of an electrically conductive material and have a general elongate length to match the elongate length of the housing 14. In the embodiment shown, the shields 34 and 36 are substantially mirror images of each other with a relatively small width and a height having a bottom portion 38, a top portion 42, and a middle portion 46 therebetween. The bottom portion 38 generally comprises a mother board contacting portion 40 which, in the embodiment shown, is provided as a plurality of solder tails. The top portion 42 extends above the top 23 of the housing 14 and has a plurality of contact areas 44 such as areas that are plated with a particularly conductive material such as gold. The middle portion 46 has a substantially flat plate like structure with the exception of a plurality of fingers 48 extending therefrom. The fingers 48 are generally formed by stamping the shields and, in the embodiment shown, generally comprise an extension section 50 extending generally perpendicular to the middle portion 46 and a leg portion 52 having a linear axis generally parallel to the height of the middle section. In the embodiment shown, located at the end of the leg portion 52 is an enlarged fixing section 54. The enlarged fixing section 54 is slightly larger than the width of the second type of contact chambers 26 and are intended to be fixedly positioned in the second type of contact chambers 26. The spacing between fingers 48, in the embodiment shown, corresponds to the spacing between second type of contact chambers 26 such that when the shields are mounted to the housing 14 the fingers 48 are positioned in each second type of contact chamber 26. The length of the leg portions 52 is suitably sized such that, with the leg portions 52 positioned in the second type of contact chambers 26, the enlarged fixing sections 54 are spaced from the lower contacts 32 to prevent inadvertent grounding of the lower contacts 32 by the grounding shields 34 and 36. The extension section 50 has substantially the same length as the width of the housing 14 between the outside of the side walls 16 and 18 and the second type of contact chambers 26. Thus, when the shields 34 and 36 are mounted to the housing 14, the fingers 48 snugly hold the shields 34 and 36 to the housing 14. Because the enlarged fixing sections 54 are slightly larger than the width of the second type of contact chambers 26, the fingers 48 are press fit into the chambers 26 and fixedly hold the shields 34 and 36 to the housing 14. In an alternate embodiment additional or alternative fixation means can be used to hold the shields to the housing 14.

The shields 34 and 36 are generally provided to perform two functions. First, the shields 34 and 36 act as grounding contacts between the daughter printed circuit board 12 and a mother printed circuit board. Second, the shields 34 and 36 act as electromagnetic interference (EMI) shields to protect the contacts 30 and 32 from external magnetic field fluctuations and, at least partially, from internally produced electromagnetic fields caused by the travel of signals in the contacts 30 and 32.

Figure 4:
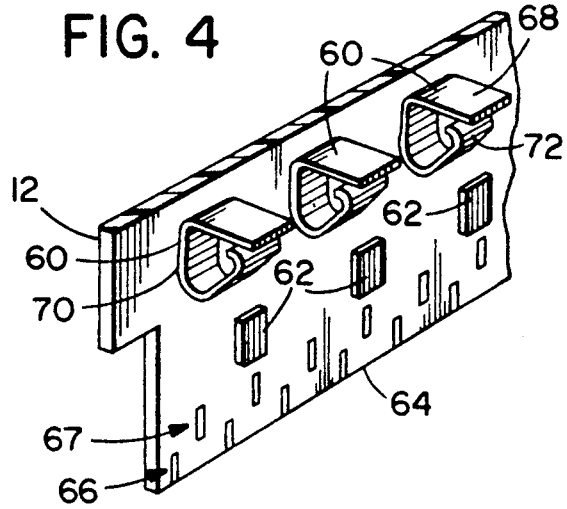
FIG. 4 is a partial perspective view of the daughter board shown in FIG. 1.

The grounding contact feature of the shields 34 and 36 is generally provided to reduce the distance or travel between the daughter board 12 and a mother board to thereby permit high speed switching. The present invention has the particular advantage of contacting grounding portions 60 of the daughter board 12 above the top 23 of the housing 14 and above the daughter board transceivers. Referring also to FIG. 4, a partial perspective view of the daughter board 12 is shown. The daughter board 12 generally comprises a leading edge 64, two rows of contact traces 66 and 67 on each side, transceivers 62, and grounding portions 60. In the daughter board 12 shown, the grounding portions 60 are located above the transceivers 62, and the transceivers 62 are located above the traces 66 and 67. The grounding portions 60, in the daughter board shown, have a general "G" shape with a flat top 68, a fixed section 70, and a leg section 72. The fixed sections 70 are fixedly connected to the daughter board 12 and connected to a ground in the daughter board. When the daughter board 12 is inserted into the connector 10, the spring leg sections 72 of the ground portions 60 contact the contact areas 44 on the shields 34 and 36. Since the mother board contacting portions 40 are connected to a ground in the mother board and, the shields 34 and 36 are relatively direct and straight between the mother and daughter boards, relative short grounding loops are established.

Figure 2B:
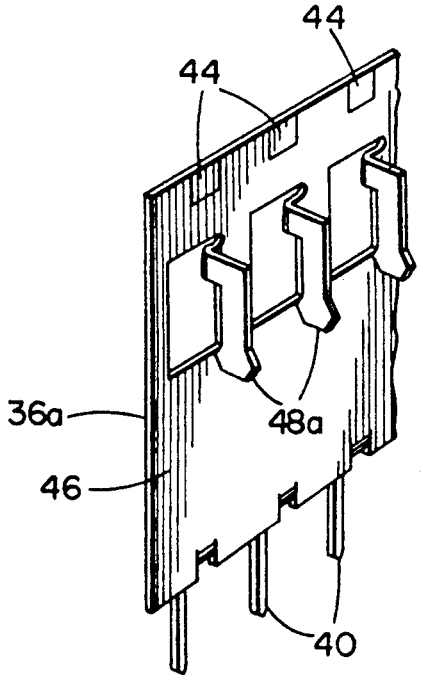
FIG. 2*b* is a partial perspective view of an alternate embodiment of the grounding shield shown in FIG. 2*a*.

As noted above, in addition to providing relatively short grounding loops, the grounding shields 34 and 36 function as EMI shields for both externally and internally generated electromagnetic interference. First, because of the plate-like shape of the shields 34 and 36 being located along substantially the entire length of both sides of the housing, externally generated magnetic fields are substantially intercepted by the shields 34 and 36 before they influence the signal contacts 30 and 32. As noted above, fluctuations in magnetic fields at the signal contacts 30 and 32 can produce false signals or degrade or otherwise change true signals. Thus, the shields 34 and 36 substantially surround the contacts 30 and 32 to prevent EMI and thereby provide a more dependable connector. In regard to internally produced EMI, because of the close spacing between contacts in the housing 14, such as about 0.05 inch to about 0.025 inch and; because higher voltage or amperage signals produce relative higher electrical spikes that produce relatively higher electromagnetic forces; and because high amperage transmissions between mother and daughter boards is sometimes desired; internally produced EMI caused by the transmission of signals can also produce false signals in adjacent signal contacts or otherwise change true signals in adjacent contacts. The shields 34 and 36 help to reduce this internally generated EMI in two ways. First, the close proximity of the middle portions 46 of the shields 34 and 36 to all of the contacts 30 and 32 at least partially intercepts electromagnetic pulses to thereby prevent the intercepted electromagnetic forces from influencing adjacent contacts. Second, the presence of the fingers 48 in the contact chambers 26 at least partially intercepts electromagnetic forces generated at the upper portions of the first type of contacts 30 to further reduce internal electromagnetic interference. Referring also to FIG. 2B, an alternate embodiment of a shield 36*a* is shown. In the embodiment shown, the shield has fingers 48*a* that are orientated substantially perpendicular to the middle portion 46 of the shield. This type of relatively wide barrier provided by the fingers 48*a* adds a greater amount of area between top portions of the upper contacts 30 and can further reduce internal electromagnetic interference that could have been caused by upper contacts 30. Although the connector 10 is described as having its fingers 48 inserted into the top portions of contact chambers, it should be understood that the connector housing 14 can have suitable separate apertures or slots for receiving the shield fingers.

As is evident from the above description of the invention, the present invention can allow for the use of the connector 10 in higher amperage applications without significant risk of an increase in electromagnetic interference. In addition, the present invention can provide greater reliability in signal transmission through the connector 10 without significant risk of cross-talk between signal contacts. Further, the present invention reduces the grounding loop distance between a daughter board and a mother board by providing a relatively direct path grounding shield, thus allowing for higher speed switching.

Figure 5:
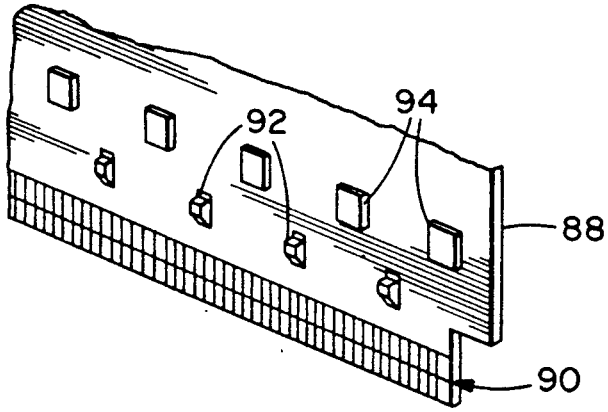
FIG. 5 is a partial exploded view of an alternate embodiment of the present invention and a daughter printed circuit board.
Figure 5:
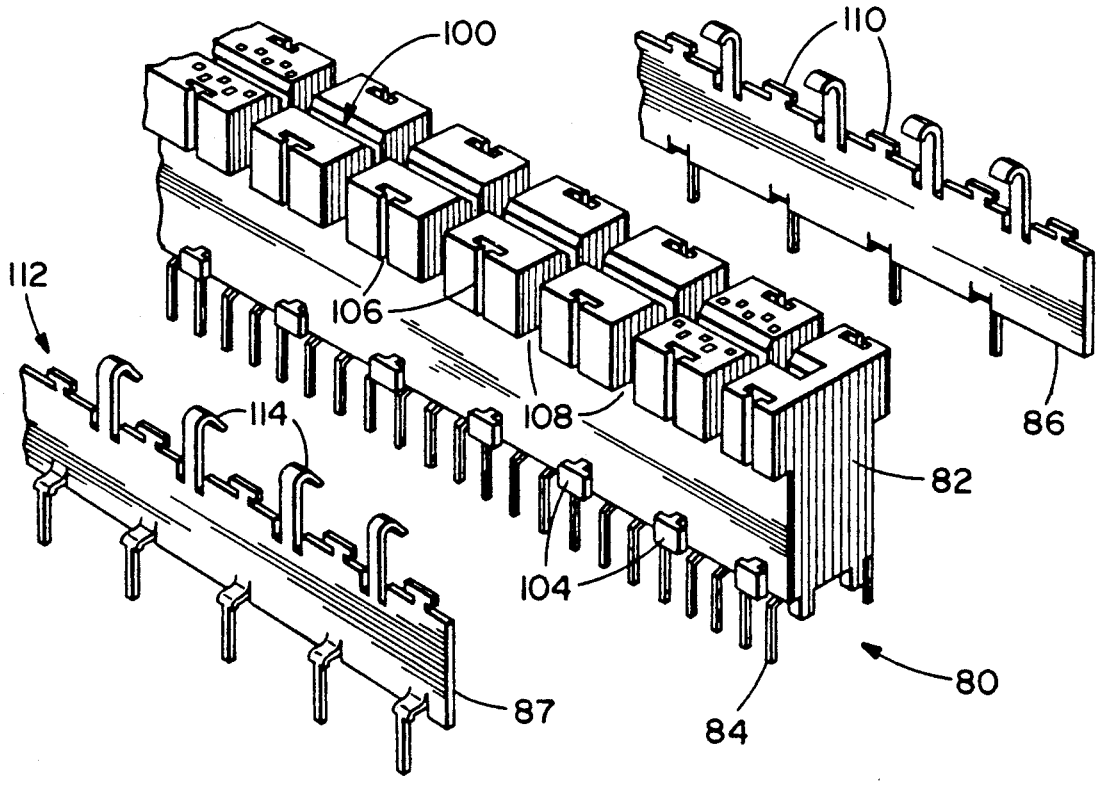
Figure 6A:
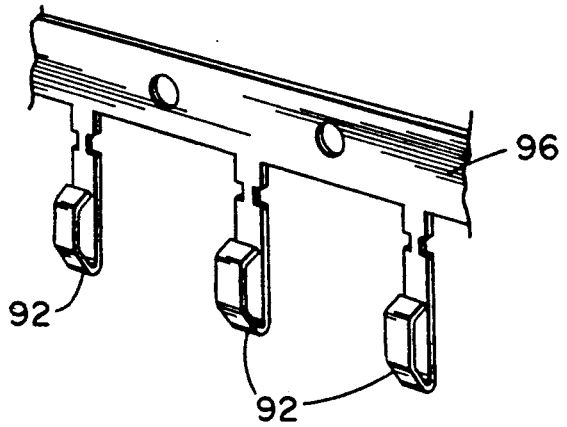
FIG. 6A is a partial perspective view of a strip of daughter board grounding contacts.
Figure 6B:
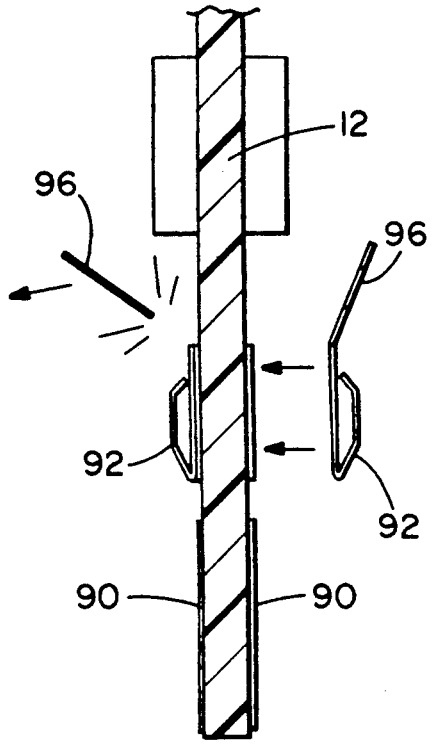
FIG. 6B is a cross sectional side view of the daughter board shown in FIG. 5 showing how the grounding contacts are connected thereto.

Referring now to FIG. 5, a partial exploded perspective view of an alternate embodiment of the invention is shown. The card edge connector 80 generally comprises a housing 82, a plurality of electrical contacts 84 therein, and two side mounted grounding shields 86 and 87. The housing 82 is generally intended to receive a portion of the daughter board 88 which has a plurality of contact traces 90, grounding contacts 92, and transceivers 94. Referring also to FIGS. 6A and 6B, the grounding contacts 92 can be generally provided on a carry strip 96. The contacts 92 are placed on the daughter board 88 and soldered thereto. After fixedly connecting the grounding contacts 92 to the daughter board 88, the carry strip 96 can then be removed. In the embodiment shown, the grounding contacts 92 have a doubled over humpback shape. However, any suitably shaped grounding contact can be provided.

Figure 7:
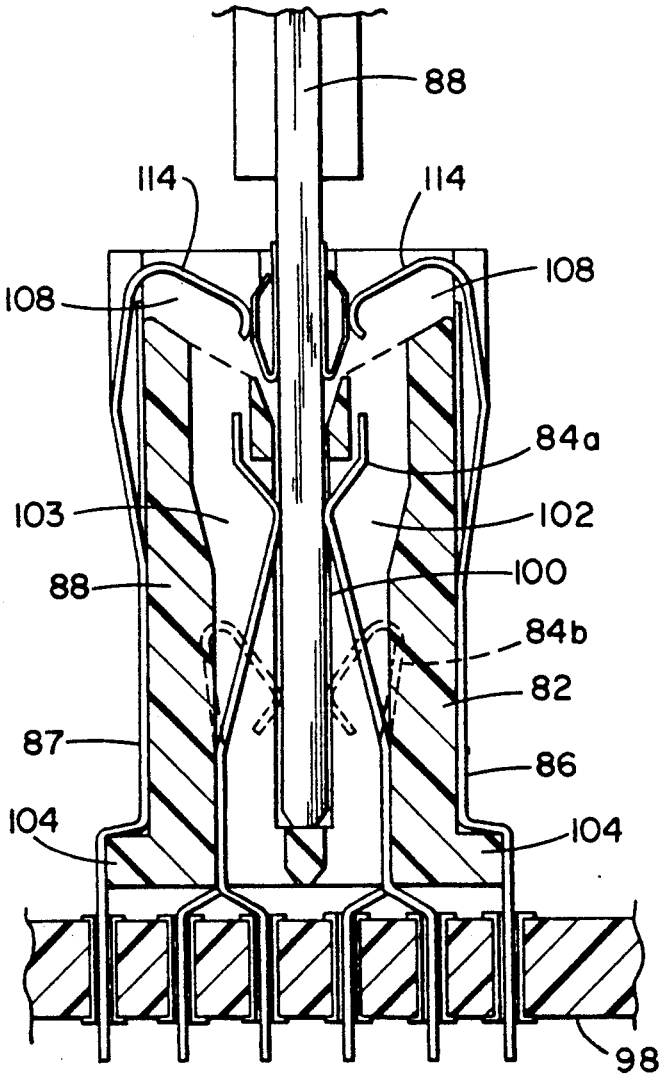
FIG. 7 is a side cross sectional view of an assembly comprising a mother printed circuit board, a daughter printed circuit board, and a ground shielded bi-level card edge connector as shown in FIG. 5.

Referring to FIGS. 5 and 7, FIG. 7 shows a cross-sectional view of the connector 80 with the daughter board 88 and a mother board 98. The housing 83 generally has a card edge receiving slot 100, two rows of contact chambers 102 and 103 on opposite sides of the slot 100, shield mounting projections 104 on the exterior sides of the housing, shield mounting receptacles 106, and shield upper portion slots 108. Positioned in the contact chambers 102 and 103 are upper and lower contacts 84*a* and 84*b*. The shields 86 and 87 are mounted to the exterior sides of the housing 82 with portions of the shields being located on and behind the mounting projections 104. The shields 86 and 87 have mounting projections 110 that are bent into position in the mounting receptacles 106. The top portion 112 of the shield, in the embodiment shown, are provided as spring contacts 114 to contact the daughter board grounding contacts 92. The spring contacts 114 are bent or stamped into position in the slots 108 as shown in FIG. 7. With the connector 82 connected to the mother board 98 and the daughter board 88 mounted in the receiving slot 100, the contacts 84 contact the traces 90 to transmit signals therethrough. The grounding shields 86 and 87 function both as a means for connecting the grounds of the daughter board with the grounds of the mother board and, as an electromagnetic shield to shield the contacts 84 from the electromagnetic interference.

Figure 8:
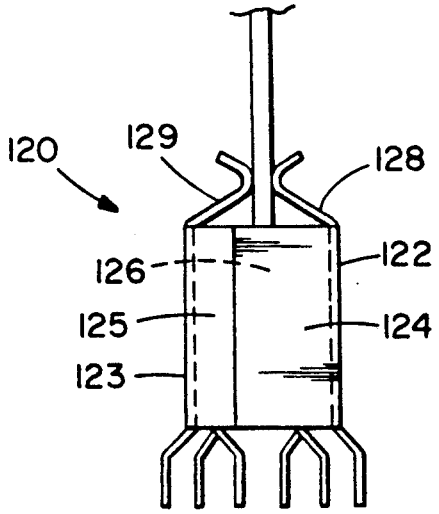
FIG. 8 is a schematic end view of an alternative embodiment of the present invention with an inserted card edge connector.
Figure 9:
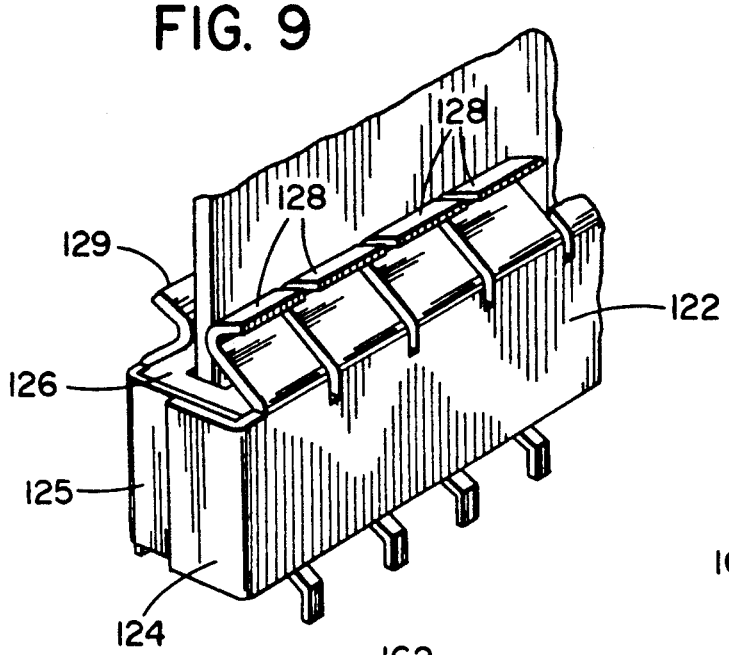
FIG. 9 is a partial perspective view of the connector shown in FIG. 8.

Referring now to FIGS. 8 and 9, an alternate embodiment of the invention is shown. In the embodiment shown, a connector 120 has two shields 122 and 123. The shields 122 and 123 have overlapping end portions 124 and 125 for covering the ends of the connector housing 126. The upper portions 128 and 129 of the shields 124 and 125 are provided as spring contacts that extend above the top of the connector housing. In still a further alternate embodiment of the invention, the grounding shield may be provided as a single piece member with a central aperture for receiving the dielectric housing. The connector 120 may also comprise suitable snap-on end caps to keep the shields 122 and 123 on the housing 126.

Figure 10C:
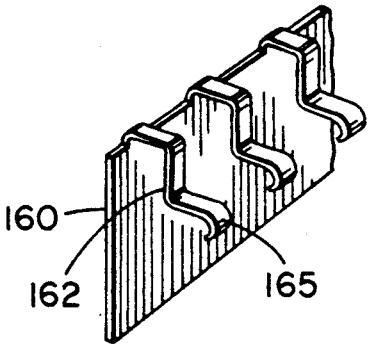
FIG. 10C is a partial perspective view of the shield shown in FIG. 10A.
Figure 10A:
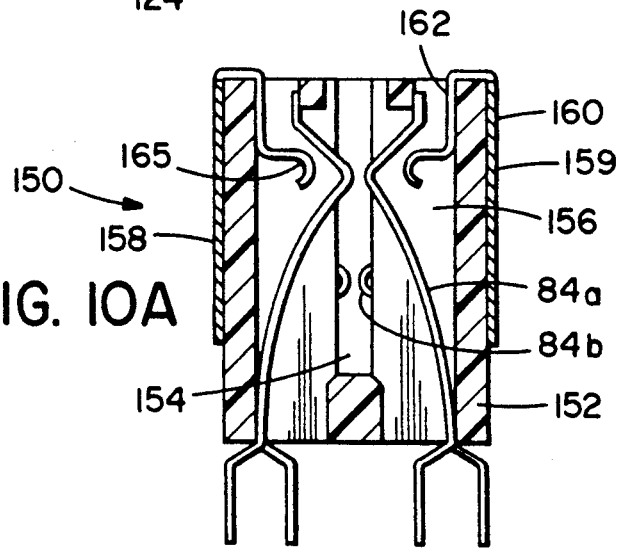
FIG. 10A is a cross-sectional view of an alternate embodiment of the invention.
Figure 10D:
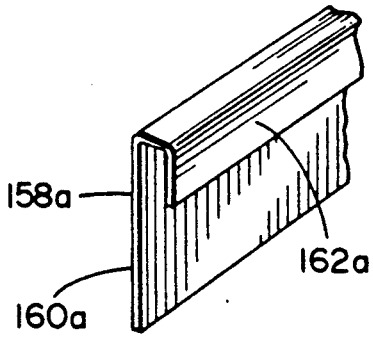
FIG. 10D is a partial perspective view of an alternate embodiment of the shield shown in FIG. 10C.
Figure 10B:
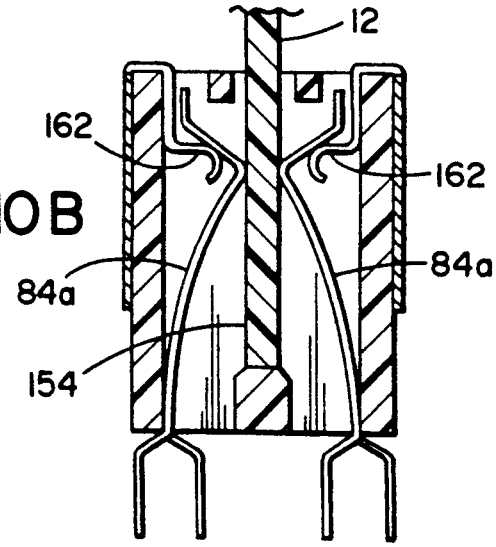
FIG. 10B is a cross-sectional view of the embodiment shown in FIG. 1OA with a daughter board inserted into the connector.
Figure 11:
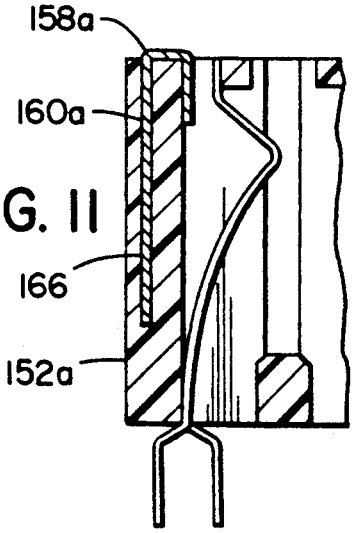
FIG. 11 is a partial cross-sectional view of an alternate embodiment of the invention.

Referring now to FIGS. 10A, 10B and 10C, an alternate embodiment of the invention is shown. In the embodiment shown, the connector 150 has a housing 152 with slot 154 and contact restraining or housing areas 156. Located in the contact housing areas 156 are upper and lower contacts 84*a* and 84*b*. The connector 150, in the embodiment shown, also comprises two shields 158 and 159 fixedly connected to the housing 152 and located along the longitudinal sides of the housing. The shields 158 and 159, in the embodiment shown, are made of a ferromagnetic material and have a plate section 160 and finger portions 162 that extend away from the plate section 160 and have contact portions 165 for contacting the upper contacts 84*a*. The finger portions 162, in the embodiment shown, extend across the top of the housing and into the top portion of at least some of the upper contact housing areas. As can be seen in FIG. 10A, without a daughter board inserted into the connector 160, the upper contacts 84*a* are spaced from the shields 158 and 159. As can be seen in FIG. 10B, with a daughter board inserted into the slot 164, the upper contacts are moved away from the slot 154 and those with finger portions in their housing areas contact the finger portions 162 to make electrical contact therebetween. Electromagnetic forces generated by electricity or signals flowing through the lower contacts 84*b* and upper contacts 84*a* used as signal contacts can be intercepted by the shields 158 and 159 and grounded through the upper contacts in contact with the shields to a ground in the mother printed circuit board via the upper contact solder tails. In addition to making an electrical connection between the shields 158 and 159, the upper contacts can make contact with traces on the daughter board connected to a ground in the daughter board. Obviously, the shields 158 and 159 can have any suitable number of finger portions 162 suitably positioned to contact only upper ground contacts and not upper signal contacts (if any). Any suitable means can be used to connect the shields to the housing. In addition, the shields need not be provided on both sides of the connector or may be provided as a single box-like member. The shields 158 and 159 may also comprise daughter board contact portions such as top portion 42 with contact areas 44 shown in FIGS. 2A and 2B or, such as spring contacts 114 shown in FIG. 5. An alternate embodiment of the shields 158 and 159 is shown in FIG. 10D. In the embodiment shown, the shield 158*a* has a single finger portion 162*a* along its length. The housing would have a suitable slot along its length to receive the finger portion 162*a*. In the embodiment shown, the finger portion is substantially flat and straight. However, any suitably shaped finger portion can be provided. Referring to FIG. 11, an alternate embodiment is shown wherein the housing 152*a* has side slots 166 for receiving the plate sections 160*a* of the shields if it is not desired to have the shields exposed along the longitudinal sides of the connector. Obviously, any suitable shaped housing can be provided.

Let it be understood that the foregoing description is only illustrative of the invention. Various alternatives and modifications can be devised by those skilled in the art without departing from the spirit of the invention.

Accordingly, the present invention is intended to embrace all such alternatives, modifications and variances which fall within the scope of the appended claims.

What is claimed is:

1. An electrical connector for mechanically and electrically connecting a mother printed circuit board and a removable daughter printed circuit board of the edge card type, the connector comprising:

a housing being comprised of an electrically insulating material and having a top surface with a slot for receiving a portion of a daughter printed circuit board and at least two rows of contact chambers on opposite sides of said slot;

a plurality of a first type of electrically conductive contacts positioned in at least some of said contact chambers;

a plurality of a second type of electrically conductive contacts positioned in at least some of said contact chambers; and a ground shield positioned along an exterior surface of said housing comprising an electrically conductive plate with solder tails extending from a bottom portion of said plate for coupling with a mother printed circuit board, at least one finger portion extending into said housing, each finger portion being located in an area between two of said first type of contacts in one of said rows, and a top portion extending above said housing top surface for connection to grounding portions on a daughter printed circuit board such that electricity from daughter printed circuit board ground portions can be transmitted to a mother printed circuit board along relatively short paths and, electromagnetic forces generated by electricity flowing through said first type of contacts can be, at least partially, intercepted by said ground shield finger portions and transmitted to a ground in a mother printed circuit board.

2. A connector as in claim 1 wherein said top portion comprises a plurality of spring contact projections for contacting ground pads on a daughter board.

3. A connector as in claim 1 wherein said top portion comprises a substantially continuous plate section for contacting spring contacts extending from a daughter printed circuit board.

4. A connector as in claim 1 wherein each of said finger portions are received in finger portion receiving apertures in said housing.

5. A connector as in claim 1 wherein said finger portion comprises means for fixedly mounting said ground shield to said housing.

6. A connector as in claim 1 wherein said finger portion comprises a relatively wide length transverse to said plate.

7. A connector as in claim 1 wherein said shield is comprised of a relatively flat plate that is stamped to form said solder tails and said finger portion, said finger portion being offset from a middle section of said plate.

8. A connector as in claim 1 wherein said ground shield comprises two plates located on opposite sides of said housing.

9. A connector as in claim 8 wherein said ground shield further comprises shield end brackets for mounting said plates to said housing.

10. A connector as in claim 1 wherein each of said finger portions are received in some of said contact chambers.

11. A connector as in claim 10 wherein said finger portions are received in every other contact chamber in one of said rows.

12. A connector as in claim 10 wherein said second type of conductive contacts are relatively short and said finger portions are received in contact chambers housing said second type of contacts in an area of said contact chambers above said second type of contacts.

13. An electrical connector for mechanically and electrically connecting a mother printed circuit board and a removable daughter printed circuit board of the edge card type, the connector comprising:

housing means of an electrically insulating material, said housing means having at least two rows of contact housing chambers and a central aperture between said rows for receiving a portion of a daughter printed circuit board;

means for contacting conductive traces on a daughter board comprising a plurality of a first type of electrically conductive contacts, each of said first type of contacts comprising a first portion formed as a solder tail positionable to extend from said housing for coupling with a mother printed circuit board and a contacting portion for contacting a daughter printed circuit board, said contacting portion being partially displaceable from a home position by the insertion of a daughter printed circuit board into said central aperture; and means for grounding electromagnetic forces generated by electricity traveling through said means for contacting, said means for grounding including at least one grounding member comprised of electrically conductive material having a mother board contacting section, a projecting finger section and a middle section therebetween, said projecting finger section comprising at least two projecting fingers, each of said fingers extending into said housing in an area between and spaced from two adjacent of said first type of contacts, said middle section being located on an exterior side of said housing means between said mother board contacting section and said projecting finger section and, connecting said fingers.

14. A connector as in claim 13 wherein said means for grounding comprises at least two grounding members located on opposite sides of said housing means.

15. A connector as in claim 13 further comprising means for mounting said grounding member to said housing means.

16. A connector as in claim 15 wherein said means for mounting comprises at least one of said projecting fingers being suitably sized and shaped to interlock said grounding member with said housing means.

17. A connector as in claim 13 wherein at least one of said projecting fingers extends from said middle section across a top surface of said housing means into a top portion of one of said contact chambers.

18. An electrical connector for mechanically and electrically connecting a mother printed circuit board and a removable daughter printed circuit board of the edge card type, the connector comprising:

an elongate housing being comprised of a dielectric material and having a top surface with a slot for receiving a portion of a daughter board and at least two rows of contact chambers on opposite sides of said slot;

a plurality of a first type of electrically conductive contacts located in at least some of said contact chambers; and a grounding shield comprising two exterior grounding plates located on opposite elongate sides of said housing, each of said grounding plates having a mother board contact section, a daughter board contact section and a middle section therebetween, said daughter board contact sections extending above said housing top surface for contacting grounding portions on a daughter board located above said housing such that electricity from daughter board ground portions can be transmitted to a mother board along a relatively short path and, electromagnetic forces generated by electricity flowing through said contacts can be at least partially intercepted by said grounding shield middle section and transmitted to a mother board to reduce cross-talk between contacts in said rows.

19. A connector as in claim 18 wherein said daughter board contact sections are suitably sized and shaped to contact grounding springs projecting from a daughter board.

20. A connector as in claim 18 wherein said daughter board contact sections are comprised of cantilevered spring projections for contacting grounding areas on a daughter board.

21. An electronic component assembly comprising:

a mother printed circuit board;

an electrical connector mechanically and electrically connected to said mother printed circuit board with a slot in a top surface of said connector, said connector having a plurality of spring contacts projecting into said slot and having opposite ends connected to said mother printed circuit board, and a grounding shield having a bottom portion connected to said mother printed circuit board and a top portion extending above said top surface; and a daughter printed circuit board connected to said connector with conductive traces of said daughter board being located in said connector slot contacted by said contacts, and further comprising surface mounted grounding contacts located above said slot contacting said grounding shield top portion.

22. An assembly as in claim 21 wherein said surface mounted grounding contacts comprise a plurality of cantilevered spring contacts.

23. An assembly as in claim 22 wherein said surface mounted grounding contacts comprise a spring protector located over said cantilevered spring contacts.

24. A method of manufacturing a card edge connector comprising the steps of:

providing an elongate housing of dielectric material having an area for receiving a portion of a daughter printed circuit board and a plurality of spring contact receiving areas;

inserting and mounting a plurality of spring contacts in the spring contact receiving areas, the contacts being capable of electrically connecting a received daughter printed circuit board with a mother printed circuit board for transmitting signals therebetween; and mounting a grounding shield to the housing, the shield being comprised of ferromagnetic material and having a general elongate shape with a daughter board contacting portion extending above the housing and adapted to contact the daughter board above the housing and a mother board contacting portion extending below the housing, the grounding shield being orientated generally parallel to the spring contacts such that the shield can at least partially intercept electromagnetic impulses generated by electricity traveling through the contacts and thereby reducing cross-talk between contacts and reducing the grounding travel distance between the daughter and mother boards.

25. A method as in claim 24 wherein the step of mounting a ground shield comprises inserting finger portions of the ground shield through holes in the housing between portions of contacts.

26. An electrical connector for mechanically and electrically connecting a mother printed circuit board and a removable daughter printed circuit board of the edge card type, the connector comprising:

a housing being comprised of an electrically insulating material and having a first surface with a slot for receiving a portion of a daughter printed circuit board and at least two rows of contact restraining areas on opposite sides of said slot;

a plurality of a first type of electrically conductive contacts positioned in at least some of said contact restraining areas said first type of contacts having a relatively tall height in said contact restraining areas and being partially moveable by insertion of a daughter board into said slot and, having mother board contact portions;

a plurality of a second type of electrically conductive contacts positioned in at least some of said contact restraining areas; and a ground shield positioned proximate an exterior surface of said housing comprising at least one electrically conductive plate section, said shield being fixedly mounted to said housing and having at least one finger portion extending from said plate section into at least two of said contact restraining areas, said at least one finger portion having a contact portion for contacting a portion of at least two of said first type of contacts when a daughter board is inserted into said slot such that upon insertion of a daughter board into said slot, at least two first type of contact contacts said shield whereby electromagnetic forces generated by electricity flowing through said contacts can be, at least partially, intercepted by said shield and transmitted to a ground in a mother board via said at least two first type of contact contacting said shield.

27. A connector as in claim 26 wherein said shield extends over a portion of said housing first surface and into said contact restraining areas.

28. A connector as in claim 26 wherein said at least one finger portion extends only partially into said contact restraining areas so as not to contact said second type of contacts.

* * * * *